United States Patent [19]

Fecteau

[11] Patent Number: 4,479,299

[45] Date of Patent: Oct. 30, 1984

[54] MACHINE AND METHOD FOR ASSEMBLING HIGH VOLTAGE FUSES WITHOUT AN INTERNAL CORE

[75] Inventor: Gilles Fecteau, Quebec, Canada

[73] Assignee: Hydro Quebec, Montreal, Canada

[21] Appl. No.: 396,333

[22] Filed: Jul. 8, 1982

[30] Foreign Application Priority Data

Mar. 11, 1982 [CA] Canada ..... 398147

[51] Int. Cl.[3] ..... H01H 69/02

[52] U.S. Cl. ..... 29/623; 29/614; 29/756

[58] Field of Search ..... 29/623, 614, 756

[56] References Cited

U.S. PATENT DOCUMENTS 3,460,085 8/1969 McAllister et al. .
3,571,775 3/1971 Kozacka .
3,810,061 5/1974 Salzer .
3,831,215 8/1974 Aleksandar et al. .
3,839,786 10/1974 Salzer .
3,848,214 11/1974 Salzer .
3,959,875 6/1976 Salzer .
4,001,748 1/1977 Salzer .
4,003,129 1/1977 Koch et al. .
4,008,451 2/1977 Salzer .
4,084,145 4/1978 Miller .
4,090,164 5/1978 Mikulecky .
4,117,441 9/1978 Wycklendt .
4,158,188 6/1979 Howard .

FOREIGN PATENT DOCUMENTS 601752 11/1974 Fed. Rep. of Germany .

*Primary Examiner*—Howard N. Goldberg
*Assistant Examiner*—P. W. Echols
*Attorney, Agent, or Firm*—Schwartz, Jeffery, Schwaab, Mack, Blumenthal & Koch

[57] ABSTRACT

An improved machine is disclosed for assembling high-voltage fuses without an internal core, which fuses comprise at least one fusible element helically wound inside a tubular casing made of electrically insulating material and filled with a pulverulent arc-quenching material. The machine comprises a mobile head comprising a plurality of threaded rods symmetrically mounted about a central axis and whose threads are especially designed for receiving and helically guiding the fusible elements. The rotation of either the whole head or each of the threaded rods about their respective axis is synchronized to the translational movement of a slidable platform on which the head is mounted. In use, the fusible elements are wound in the threads of the threaded rods by rotation of the mobile head about its central axis. Subsequently, the fusible elements are unwound inside the tubular casing by combining a translation of the platform with a rotation of each of the threaded rods of the mobile head at a given ratio.

18 Claims, 13 Drawing Figures

85
41
137
139
33
113
111
83
81
79
77
39
67
66
65
61
63a
27
71
71
37
77
87
35
7
31a
3
5
9
57
55
53
45
23
48
47

FIG. 4
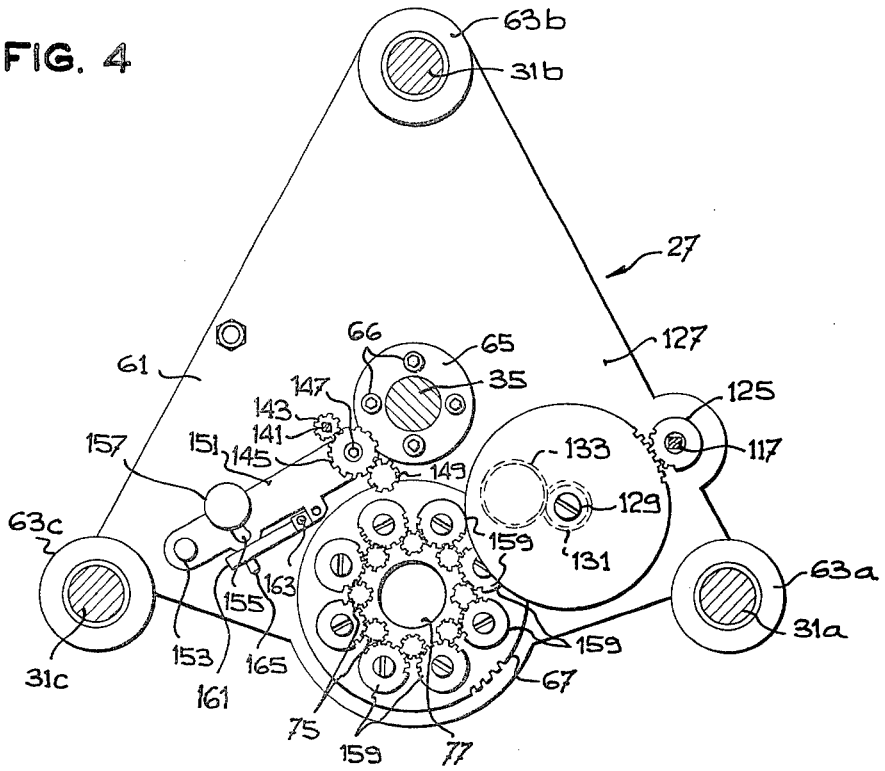
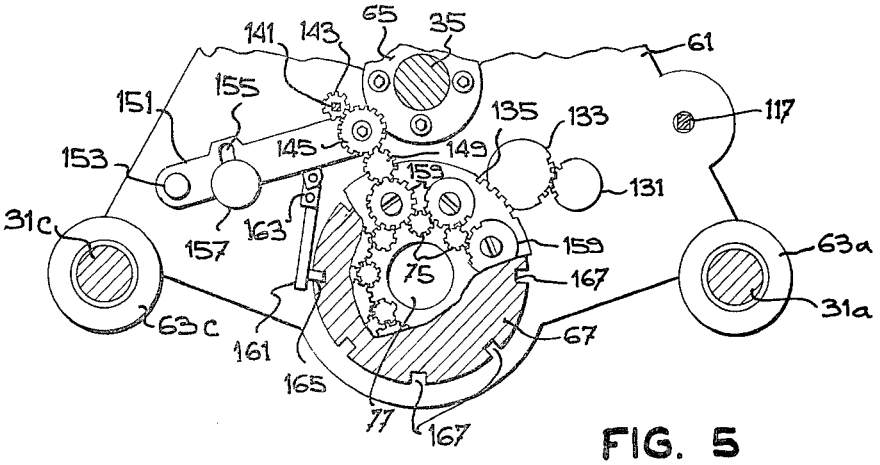
FIG. 5

FIG. 6
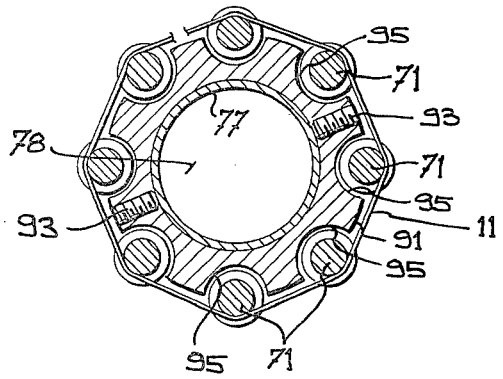
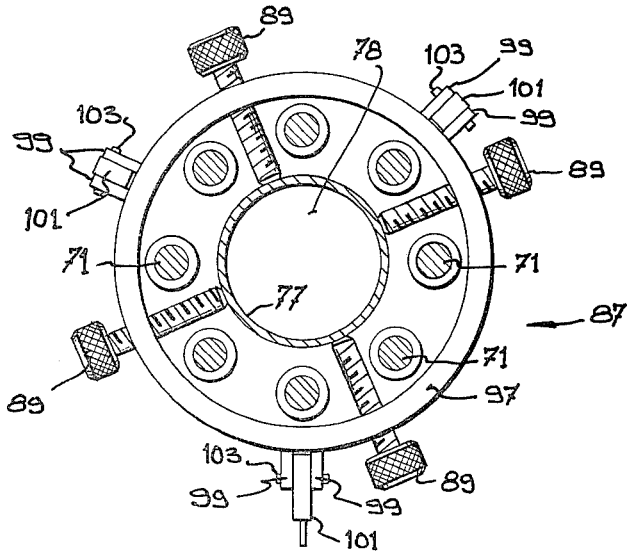
FIG. 8
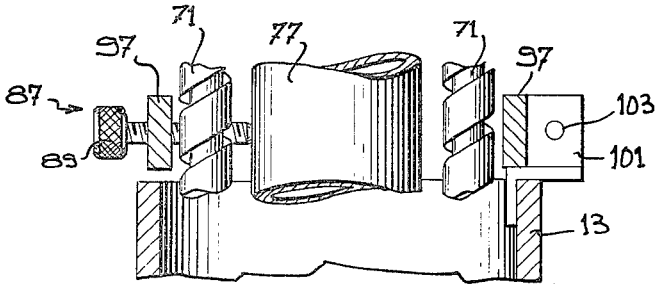
FIG. 9

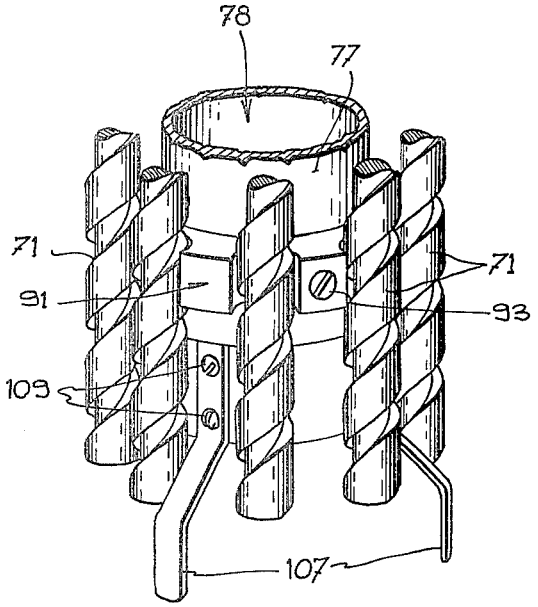
FIG. 7
FIG. 11
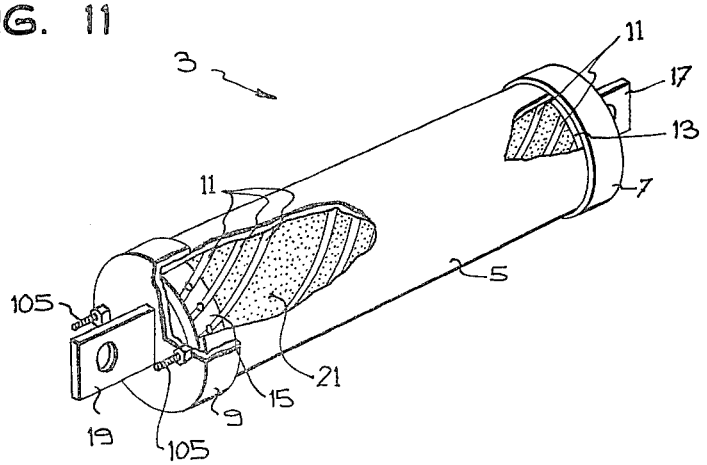

MACHINE AND METHOD FOR ASSEMBLING HIGH VOLTAGE FUSES WITHOUT AN INTERNAL CORE

BACKGROUND OF THE INVENTION

1. Field of the Invention

The present invention relates to an improved machine and method for assembling high voltage fuses without an internal core, which fuses comprise at least one fusible element helically wound inside a tubular casing made of an electrically insulating material and filled with a pulverulent arc-quenching filler.

2. Discussion of Related Art

A known method conventionally used for assembling high voltage fuses consists of winding one or several fusible elements, usually made of silver, around a rigid core made of an insulating material such as ceramic, steatite or mylar. The fusible elements are then inserted with their supporting core inside a tubular casing which is subsequently filled with quartz and/or any other pulverulent filler capable of absorbing the energy produced when a fault current is interrupted or switched off. After the tube is filled, each of its ends is sealed with a cap.

This type of high voltage fuse, which is provided with a supporting core, has proven to be quite efficient up to now. Unfortunately, it has also proven to have at least two major drawbacks.

First of all, when the fuse is subjected to an overload current for a long period of time, its internal temperature increases in a non-uniform manner. The voltage distribution inside the fuse is then affected by the presence of the core whose thermic coefficient and dielectric constant are different from the thermic coefficient and the dielectric constant of the pulverulent filler. This first drawback results in practice in a substantially lower stability of the fuse when a current is switched off.

Secondly, the presence of the core inside the fuse substantially increases the cost of manufacture of the fuse.

To obviate these two drawbacks, it has been proposed to manufacture and use high voltage fuses without a core in order to improve the current breaking ability of the fuse, to insure a better electrical restoration after break and to reduce the cost of manufacture. Machines and methods for assembling such high voltage fuses without a core are described by way of example, in U.S. Pat. Nos. 3,831,251 of 1974; 3,839,786 of 1974; 3,848,214 of 1974; 3,959,875 of 1976; 4,003,129 of 1977; and 4,008,451 of 1977. A similar method of manufacture is also described by way of example in German Pat. No. 601,752 of 1934.

If the machines and methods described in these patents all have some advantages, they also have the common drawback of being very specific. That is, they are each restricted to the manufacture of a very specific kind of fuse, whereas it is known that the manufacture of fuses having a small nominal value is different from the manufacture of fuses having a high nominal value; the former requiring only a small fusible element while the latter, which are generally also designed for breaking small overload currents, require a plurality of fusible elements whose relative spacing inside the casing easily reaches a critical minimal value that must be strictly controlled.

It is also known that the manufacture of high voltage fuses without a core involves technical problems that are completely different depending on the shape, size and mechanical characteristics of the fusible elements. Thus, by way of example, the technical problems encountered when using circular wires or rectangular wires as fusible elements are completely different. Similarly, the problems encountered when manufacturing fuses are completely different if the mechanical characteristics of the metal used for the fusible elements or the number of elements inserted inside each tubular casing are different.

As previously indicated, most of the machines or methods proposed up to now for assembling high voltage fuses without a core are, unfortunately, applicable only to a small number of fusible elements. Also, the known machines and methods require a lot of skill from their operators and cannot be automated easily. Furthermore, they give very little freedom to fuse designers for selecting the structural elements of the fuses and they also often generate a plurality of constraints which must be met when assembling the fuses, especially in view of the fact that it is well known that the fusible elements must be helically wound inside the tubular casing to obtain fuses having a reasonable and useful size.

SUMMARY OF THE INVENTION

One object of the present invention is to provide an improved machine which overcomes the above-mentioned drawbacks.

More particularly, an object of the present invention is to provide an improved machine that can be used with any kind of fusible elements regardless of shape, size or mechanical characteristics, without requiring any other support means, and that can also be easily automated because of its very simple structure.

The improved machine according to the present invention is of the same type as the machines already described in German Pat. No. 601,752 or in U.S. Pat. No. 3,831,251. Therefore, the machine according to the invention comprises, as the machines described in these two patents:

- a base provided with means for receiving and supporting the tubular casing of the fuse;
- a platform slidably mounted along guide means positioned so as to allow motion of the platform in a direction perpendicular to the base;
- means for moving the platform along the guide means towards the base or opposite thereto;
- a mobile head mounted onto the platform, said mobile head comprising a rotation axis directed towards the base and means for helically winding at least one fusible element about the mobile head and subsequently helically unwinding the same inside the tubular casing;
- means for rotating said mobile head about its axis in at least one direction; and
- hopper means for filling the tubular casing with a pulverulent arc-quenching filler in order to secure the fusible element when it is unwound from the mobile head.

In the machines disclosed in the above-mentioned German and U.S. patents, the mobile head consists of a hollow tube optionally provided with a thread around its external periphery for receiving the fusible elements. In contrast, the improved machine according to the present invention distinguishes over these known machines in that its mobile head comprises at least three threaded rods symmetrically mounted about the rotation axis of the mobile head, the threads of these rods forming the means for winding and unwinding the fusible elements, and means for simultaneously rotating the threaded rods at the same speed and in the same direction about their respective axes.

The means for rotating the threaded rods are coordinated with the means for moving the platform along its guide means so that the rotation of the rods about their axes is synchronized with the translational movement of the movable platform on which the rods are mounted. This synchronization takes place when the platform moves away from the base in a direction ensuring self-unwinding of the at least one fusible element mounted onto the threads of the rods inside the tubular casing.

The use of a plurality of threaded rods in lieu of one single screw as a mobile head has the great advantage of substantially reducing the frictional stress applied by the head to the fusible elements during unwinding thereof, and thus substantially reduces the risk of rupture of the fusible elements, whatever be their shape, size or mechanical characteristics.

In this regard, various tests carried out on the prior art machines have shown that fusible elements of small size, helically wound around one single screw, often break because they are strongly tightened when the head is unscrewed during insertion of the fusible elements inside the tubular casing. Indeed, fusible elements that are in contact with the surface of the screw all around the same are subjected to a strong friction which results in breakage. The same tests carried out on the machine according to the present invention have shown that fusible elements that are tangential to the threaded rods are not subject to such a strong friction and therefore are less subject to stress generated during their unwinding.

This reduction in the frictional stress results in turn in a substantial increase in the freedom of choice of the fuse designers as to the shape, size and mechanical characteristics of the fusible elements.

According to a preferred embodiment of the invention, the mobile head comprises eight threaded rods, preferably interchangeable, and means for rotating the mobile head about its central axis as well as means for rotating each threaded rod about its own axis. These means consist of sets of gear wheels driven by a pair of driving shafts coupled to an endless screw acting as a means for moving the platform along its guide means.

Another object of the invention is to provide a method for assembling high voltage fuses without an internal core of the above-mentioned type. This method, as the method described in German Pat. No. 601,752 and U.S. Pat. No. 3,831,251, comprises:

a first step wherein at least one fusible element is helically wound onto a mobile head movable in translation and rotatable with respect to an axis, this first step comprises the fixation of one end of the fusible element to a ring detachably mounted onto the mobile head, the rotation of this mobile head about its axis until the fusible element is completely wound, and the fixation of the other end of the fusible element to another ring detachably mounted onto the head, a second step comprising the insertion of the mobile head into the tubular casing, the removal of both rings from the mobile head and their fixation to both ends of the tubular casing, and the positioning of the whole assembly adjacent to the base; and a third step wherein the fusible element is helically unwound from the mobile head inside the tubular casing by rotation of the mobile head with simultaneous translation thereof with respect to the tubular casing for helically unwinding said fusible element inside the tubular casing, while simultaneously filling said tubular casing with a pulverulent arc-quenching filler, for maintaining said fusible element in its original, helicoidal position when the same is helically unwound in the tube.

This method distinguishes over the known ones in that:

use is made of a mobile head comprising at least three threaded rods symetrically located around its central axis;

the first step includes the insertion of the fusible element inside the threads of the threaded rods and the rotation of all the rods about the central axis of the head for winding the fusible element; and the third step comprises the rotation of each of the threaded rods with respect to their respective axes, all these threaded rods remaining in the same position with respect to the central axis of the mobile head.

BRIEF DESCRIPTION OF THE DRAWINGS

The invention and its various advantages will be better understood with reference to the following non-restrictive description of a preferred embodiment thereof, made in connection with the accompanying drawings in which:

FIGS. 4 and 5 are top plan views of the platform of the machine shown in FIG. 1;

FIG. 6 is a top plan view of the lower support of the threaded rods of the mobile head of the machine shown in FIG. 1;

FIG. 7 is a perspective view of the device for attaching the lower ring used for fixing the fusible elements of the fuse assembled in accordance with the present invention;

FIG. 8 is a top plan view of the device for attaching the upper ring used for fixing the fusible elements of the fuses;

FIG. 9 is a cross-sectional, side elevational view of the device shown in FIG. 8;

FIG. 11 is a semi-exploded perspective view of a high voltage fuse without a core as assembled with the improved machine according to the present invention.

DETAILED DESCRIPTION OF THE PREFERRED EMBODIMENT

Figure 1:
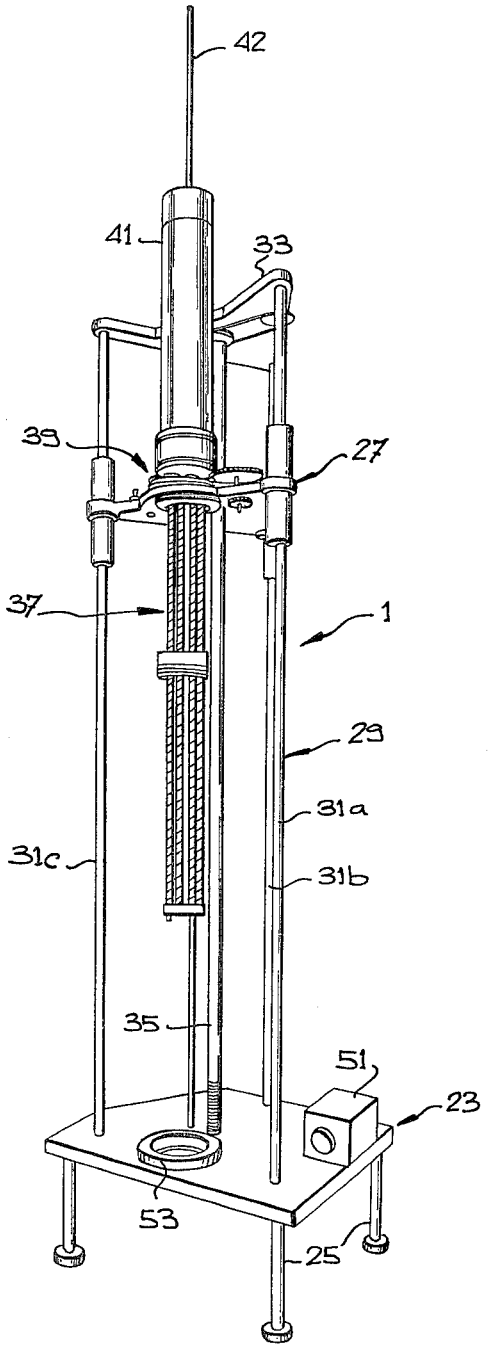
FIG. 1 is a perspective view of the machine for assembling high voltage fuses without a core according to the invention.

The improved machine 1 shown in perspective in FIG. 1 is designed for assembling high voltage fuses 3 without a core, as shown in FIG. 11.

Fuse 3 comprises at least one fusible element 11 generally made of silver, which is helically wound inside a tubular casing 5. Casing 5 is made of insulating material and is filled with a pulverulent, granular, arc-quenching filler 21 such as quartz sand or other material able to absorb the power generated by interrupting a fault current. The tubular casing 5 is closed at both ends by caps 7 and 9 on which are mounted tongues 17 and 19 for use in fixing the fuse to a distribution line. To ease the insertion and assembly of the fusible elements 11, the fuse 3 also comprises two fixation rings 13 and 15 on which the ends of the fusible elements 11 can be welded. Rings 13 and 15 are provided with fixation devices 105 that can comprise a pair of threaded rods that can be inserted through the caps of the casing 5 and fixed thereto by bolts.

As indicated above, the fusible elements 11 must be helically wound inside the tubular casing 5 because elements 11 must be sufficiently long to support a high voltage while fuse 3 must have a size sufficiently small to allow it to be used and installed on a distribution line. In order to satisfy these two requirements, the designer of the fuse may vary the shape, size and mechanical characteristics of the fusible elements, or may vary the number of fusible elements 11 inserted in the casing 5, keeping in mind that it is necessary to maintain a spacing between the elements 11 which is greater than a critical value. This spacing must be accurately controlled to avoid formation of arcs and short-circuits.

Figure 2:
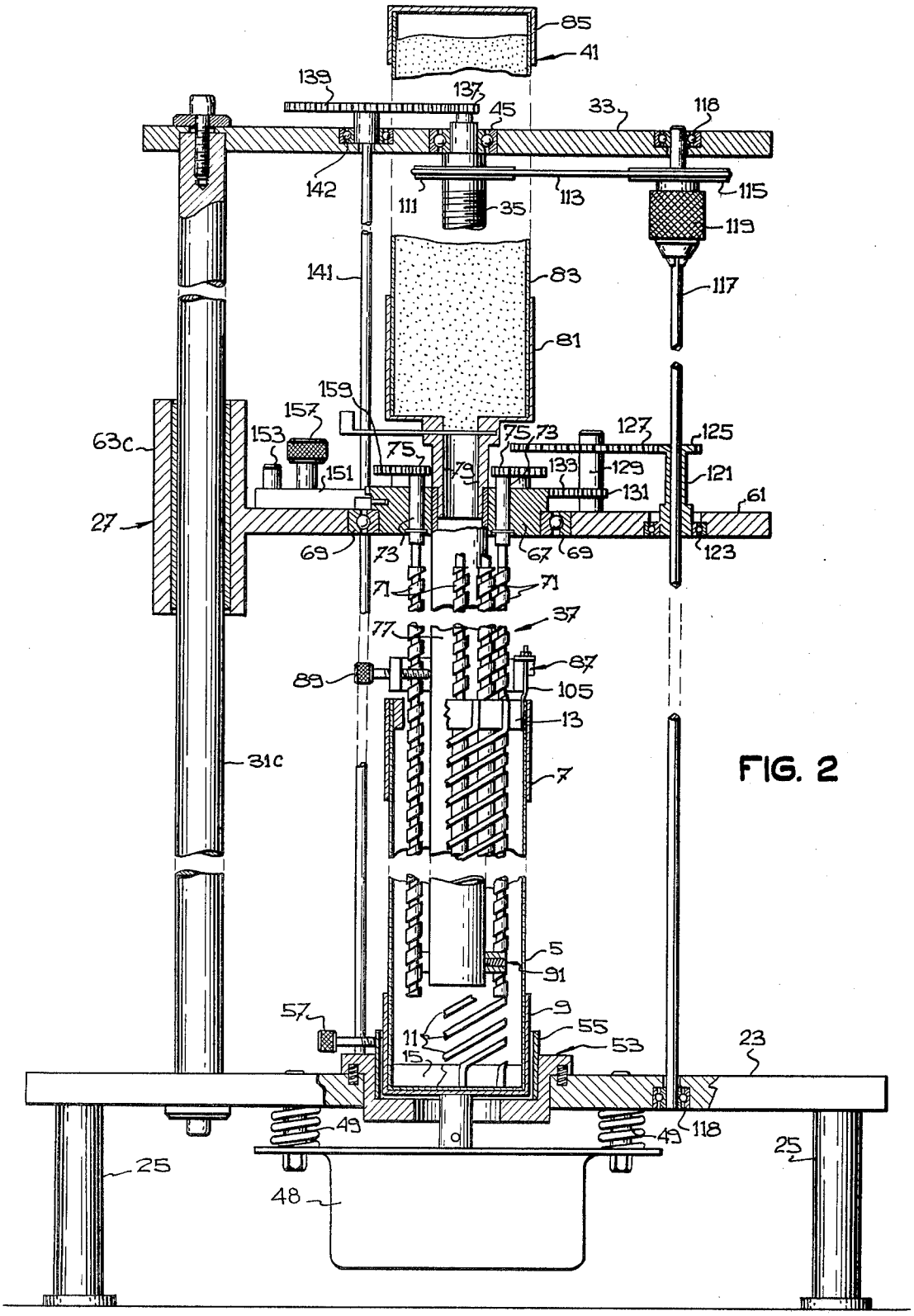
FIG. 2 is a partial, cross-sectional front view of the machine shown in FIG. 1.
Figure 3:
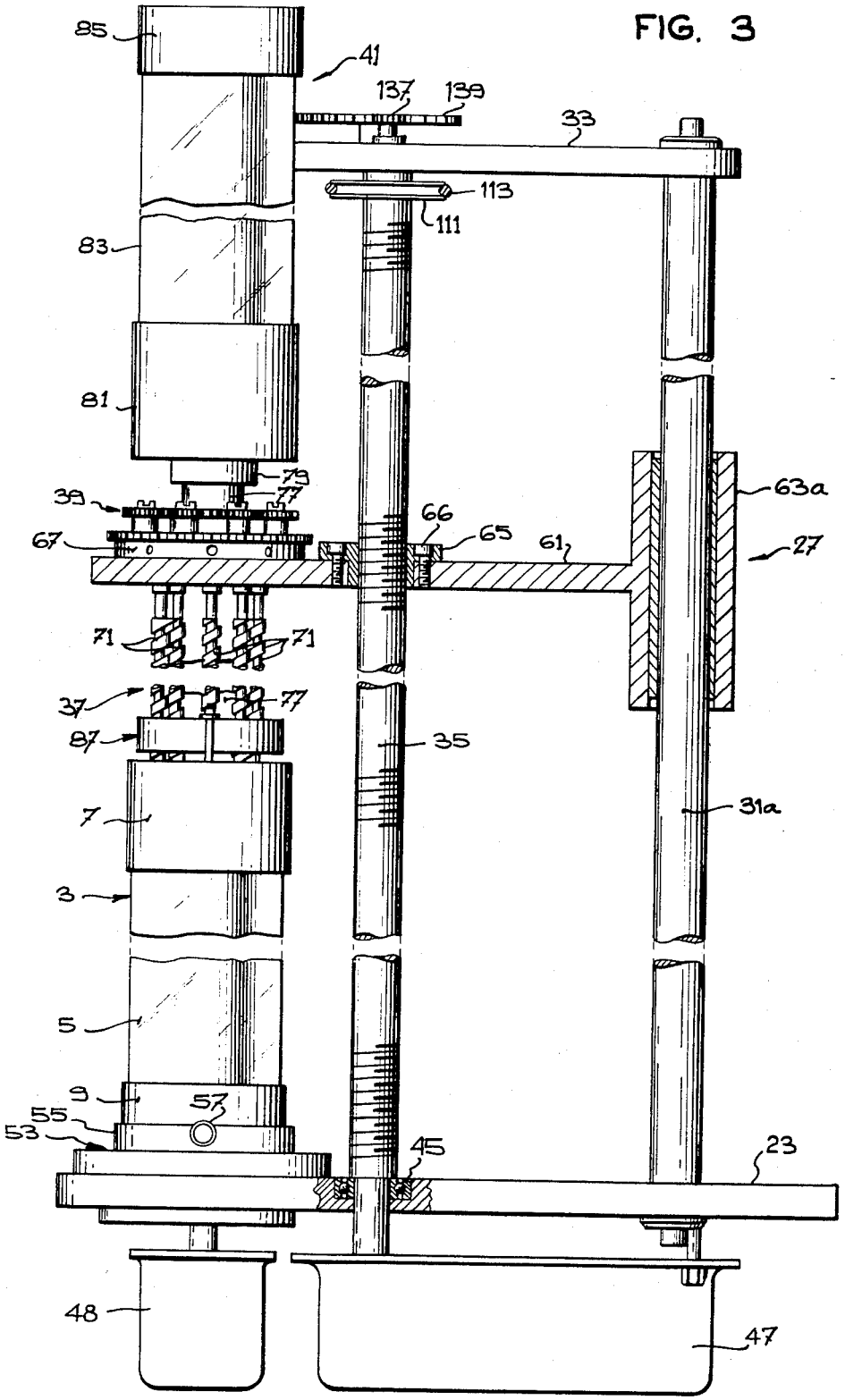
FIG. 3 is a partial cross-sectional side elevational view of the machine shown in FIGS. 1 and 2.

Referring again to FIG. 1, the improved machine 1 according to the present invention comprises a base 23 extending in a horizontal plane. The base 23 is mounted on legs 25 which are adjustable in height and is provided with structure 53 for receiving and supporting the tubular casing 5 of the fuse. The base 23 is also used as a support for a motor 47, as shown in FIG. 3. This motor is operated by a potentiometer 51 shown in FIG. 1. The base 23 is further used for supporting three guide rods 31*a*, 31*b* and 31*c* shown in FIGS. 1, 2 and 3, extending perpendicularly to the base and along which a slidable platform 27 can move.

The slidable platform 27 is moved along the guide rods 31*a*, 31*b* and 31*c* by an endless screw 35 which is rotated by motor 47. Depending on the direction of rotation of screw 35, the platform may move along the rods 31*a*, 31*b* and 31*c* either towards the base 23, or in the opposite direction towards a frame 33 which extends parallel to the slidable platform 27. The function of frame 33 is to maintain the upper ends of the rods 31*a*, 31*b* and 31*c* in spaced relation.

The platform 27 supports a mobile head 37 having a control axis directed towards the base 23. This head comprises apparatus 39 for helically winding at least one fusible element 11 about its central axis of rotation and then helically unwinding the same element inside the tubular casing 5 of the fuse 3.

Furthermore, the improved machine 1 shown in FIG. 1 comprises hopper 41 for filling the tubular casing 5 with a pulverulent arc-quenching filler to rigidly embed the fusible elements 11. In this manner, elements 11 are solidly maintained during the helical unwinding operation inside the tubular casing 5 which is vertically positioned on the support 53.

As shown in greater detail in FIG. 3, the motor 47 is mounted under the base 23. A vibrator 48, shown in FIGS. 2 and 3, is also mounted under the base 23 with a plurality of spring supports 49. Vibrator 48 transmits vibrations to the support 53 and tube 5 and thus aids the downward movement of the pulverulent material and helps compact the same when it falls from hopper 41 into the tubular casing 5. The support 53, which is used for supporting the lower end of the tubular casing 5 and its cap 9, consists of a bored-out piece incorporating a holding sleeve 55 and a fixation screw 57. The sleeve 55 receives and rigidly maintains the fuse 3 in a vertical position. The screw 57 is used to lock and solidly maintain the cap 9 and tubular casing 5 in a vertical position after they have been inserted into the sleeve 55 and support 53.

The platform 27, which is slidably mounted on guide rods 31*a*, 31*b* and 31*c* and which may be moved along these rods perpendicularly to the base 23 in one or the other direction, comprises a plate 61 extending in a horizontal plane parallel to the plane of the base 23. The platform 27 also comprises three sleeves 63*a*, 63*b* and 63*c* integrally mounted to the horizontal plate 61. Sleeves 63*a*, 63*b* and 63*c* engage the rods 31*a*, 31*b* and 31*c*, respectively, and are used for guiding the platform 27 along the rods while maintaining the plate 61 in parallel position with respect to the base 23.

As previously indicated, the platform 27 is moved by an endless screw 35. Contrary to the guiding rods 31*a*, 31*b*, and 31*c* that are rigidly fixed to the base 23 and frame 33, screw 35 is mounted onto the base 23 and frame 33 by a pair of bearings 45 that make it rotatable about its axis when driven by the motor 47. The endless screw 35 passes through the plate 61 of platform 27 and drives the same by engagement with a nut 65 rigidly mounted onto the plate 61 of the platform 27 by a plurality of small screws 66.

As can be easily understood, the rotation of the endless screw 35 in one direction or the other results in a translation of the slidable platform 27 upwards or downwards with respect to the base 23, along the guide rods 31*a*, 31*b* and 31*c*.

The horizontal plate 61 of the slidable platform 27 acts as a support for a disc 67 that forms an integral part of the plate 61 on which it is rotatably mounted by a bearing 69. The disc 67 acts in turn as a rotary support for the mobile head 37 which is coaxially mounted under it so as to extend towards the tubular casing support 53 of the base 23.

According to the present invention, the mobile head 37 advantageously consists of at least three threaded rods 71 symmetrically mounted around an axis forming the central axis of the mobile head. The threaded rods 71 act as supports for the fusible elements 11 that have to be unwound inside the tubular casing 5. For this purpose, each rod 71 is provided with a thread whose shape is chosen to receive, guide and support at least one fusible element 11 while simultaneously reducing to a maximum extent the friction that may occur when winding or unwinding the same. The number of rods 71 depends on the diameter of the tubular casing 5, and/or, in a more general manner, on the specifications of the mobile head 37 that is used. However, use will preferably be made of 6 or 8 threaded rods 71, as shown in the drawings, for providing a very regular support to the fusible elements 11 without unduly increasing the risk of friction.

The rods 71 and head 37 are removably mounted at their upper ends 73 under the disc 67. The advantage of making such rods 71 removable is to allow replacement thereof whenever desired, such as, for example, when use has to be made of rods having a different thread depending on the shape, size, or mechanical characteristics of the fusible elements to be wound. The threaded rods 71 are mounted under the disc in such a manner that they may rotate about their respective axes. For this purpose, the upper end of every rod 71 passes through the disc 67, slightly extends over the upper surface of the disc and is provided with a small gear-wheel 75 that, in operation, may be rotated as will be described hereinafter in greater detail.

The mobile head 37 also comprises a centrally located, supply tube 77 which is hollow and defines a passage 78. The tube 77 is fixed in a rigid manner directly onto the disc 67 and extends from the top of the disc down to the lower ends of the threaded rods 71. Supply tube 77 is used to allow the pulverulent arc-quenching filler to fall by gravity from hopper 41 in the tubular casing 5 while mobile head 37 moves upwardly when the fusible elements 11 are unwound within the tubular casing.

In operation, the upper end of the supply tube 77 can be connected to the bottom end of the hopper 41 containing the pulverulent filler 9 by means of a fixation ring 79. As shown in the drawings, the hopper 41 comprises a cap 85, a main body 83, and a bottom 81 on which is mounted the fixation ring 79. The supply tube 77, which is rigidly fixed onto the disc 67, is rigid and acts as a support for a first device 87 for removably attaching the upper ring 13 of the tube 3 whenever this is necessary. The attachment device 87, which will be described in greater detail hereinafter with reference to FIGS. 8 and 9, is advantageously designed to be adjustable along the supply tube 77 by use of a plurality of fixation screws 89. These screws allow the adjustment of the length of the threaded rods 71 for winding different fusible elements depending on the length of the tubular casing 5 of the fuse 3.

The supply tube 77 of the mobile head 37 also acts as an adjustable support for a holding ring 91 used for holding the lower ends of the threaded rods 71 together.

As shown in greater detail in FIGS. 2, 6 and 7, the holding ring 91 is fixed directly onto the supply tube 77 by small set screws 93. The external periphery of the ring 91 is provided with a plurality of recesses 95 whose shape and position are selected so as to let them receive the threaded rods 71. The main advantage of using such a holding ring 91 is to avoid the lower ends of the threaded rods 71 being urged towards the central axis of the mobile head due to excessive tightening of the fusible elements 11 when the same are wound on the external periphery of the mobile head. FIGS. 8 and 9 show in greater detail the device 87 used for attaching the upper ring 13, which supports the fusible elements 11 at a suitable height on the mobile head. This height corresponds to the length of the tubular casing 5 of the fuse 3. Attachment device 87 comprises a large ring 97 having a diameter sufficient for surrounding all the threaded rods 71. Ring 97, which is fixed at the desired height onto the tube 77 by screws 89, is provided with three stirrups 99 symmetrically mounted around its outer periphery. Stirrups 99 act as supports for three fingers 101 pivotably mounted thereto by pivot pins 103. In operation, fingers 101 engage the internal periphery of the upper ring 13, on which are welded the fusible elements 11 of the fuse 3, in order to center it with respect to the central axis of the mobile head. Once ring 13 has been centered by fingers 101, ring 13 is fixed onto the device 87 by its attaching devices 105 which are fixed directly onto the ring 97.

In addition to device 87 for attaching the upper ring 13 of the fuse 3, the mobile head 37 also comprises a device for removably attaching the lower ring 15 of the fuse 3. Ring 15 acts as a support for the lower ends of the fusible elements 11. This other attaching device comprises a plurality of resilient blades 107, shown in FIG. 7, fixed by small screws 109 all around the periphery of the lower end of the supply tube 77 at the lower end of the mobile head. The lower ring 15 can engage blades 107 and be retained thereon by radial deformation of the blades.

In addition to the above described structural elements, the machine 1, shown in the drawings, comprises a mechanical arrangement for rotating the mobile head as a whole about its vertical axis; that is, for rotating the disc 67 and all the elements that are mounted thereon.

The arrangement for rotating the mobile head comprises a first driving shaft 117 mounted by bearings 118 between the base 23 and the frame 33 in a direction parallel to the direction of the endless screw 35. The first driving shaft 117 is coupled to the endless screw 35 so as to be rotated by the endless screw when it is rotating. The coupling includes a belt 113 mounted between a first pulley 111, rigidly fixed to the upper end of the endless screw 35, and a second pulley 115, rigidly fixed to the upper end of the driving shaft 117.

The second pulley 115, mounted onto the driving shaft 117, is provided with a mandrel 119 that can be engaged or disengaged by mere rotation of a wheel to transmit or not transmit the rotation of the endless screw 35 to the driving shaft 117 whenever necessary.

When the second pulley 115 is fixed by the mandrel 119 to the shaft 117, it transmits the rotation of the endless screw 35 to the shaft. The shaft, which preferably has a square or hexagonal section, transmits in turn its rotational movement to the disc 67. To accomplish this, the horizontal plate 61 of the slidable platform 37 is provided with a vertical slider 121 which is mounted to slide longitudinally along the shaft 117. The slider is also mounted in a rotational manner directly onto the slidable platform by a bearing 123 so as to rotate about its own axis, which is coaxial with the axis of the shaft 117, regardless of the position of the platform with respect to base 23. Slider 121 acts as a support for a small gear-wheel 125 whose axis is coaxial to the axis of the shaft 117. This gear-wheel 125 transmits the rotational movement of the slider 121 and therefore of the driving shaft 117 to a second gear-wheel 127 mounted about an axis 129 rigidly fixed to the horizontal plate 61 of the slidable platform. The axis 129 also supports a small gear-wheel 131 extending under the gear-wheel 127 and engaging in turn a further gear-wheel 133 which in turn engages a set of teeth 135 mounted around the periphery of the disc 67 for rotating the same about its axis.

The gear ratio of the gear assembly including the gear-wheels 125, 127, 131, 133 and 135, is selected to ensure rotation of the mobile head 37 about its vertical axis at a speed suitable for allowing easy winding of the fusible elements in the threads of the threaded rods 71 after one end of each of these fusible elements is fixed either to the ring 13, or to the ring 15. Of course, the direction of the rotation transmitted to the head depends on the ring selected for fixing the ends of the fusible element. By way of example, in the machine shown in the attached drawings, it will be necesary to rotate the mobile head 37 clockwise when seen in top plan view if the ends of the fusible elements are fixed to the lower ring 15, while it will be necessary to rotate this head counter-clockwise if the ends of fusible elements are fixed to the upper ring 13.

As will be described hereinafter in greater detail, the above described apparatus for rotating the head is exclusively used for winding the fusible elements 11 around the periphery of the mobile head 37.

To ensure that fusible elements 11 are unwound in the tubular casing 5 once the elements have been inserted in the threads of the threaded rods 71 and welded to the rings 13 and 15, use is made of an apparatus for rotating all of the threaded rods 71 simultaneously at the same speed and in the same direction about their respective axes. This apparatus is coupled to the apparatus for moving the slidable platform along the guide rods 31 so that rotation of the rods 71 about their axes is synchronized with the translational movement of the slidable platform 27, on which the rods are mounted. During rotation of the rods, the platform moves away from the base and is transported in a direction ensuring self-unwinding of the fusible elements mounted on the threaded rods 71 in the tubular casing 5. In the illustrated machine, the direction ensuring self-unwinding of the fusible elements is counter-clockwise when seen in a top plan view.

The apparatus for rotating the threaded rods 71 comprises a second driving shaft 141 mounted on bearings 142 between the base 23 and the frame 33. Driving shaft 141, which extends in a direction parallel to the direction of the endless screw 35, is coupled to the screw 35 by a coupling system consisting of a set of gear-wheels 137 and 139 respectively fixed to the upper ends of the endless screw 35 and driving shaft 141, above the frame 33. The coupling ratio of the gear-wheels 137 and 139 is selected so that the driving shaft 141 rotates at a speed sufficient to provide the required synchronization.

The driving shaft 141 passes through a second slider 143 rotatably mounted on the horizontal plate 61 of the slidable platform 27 so as to be rigid in translation but rotatable about its axis. The slider 143 is used for transmitting the rotational movement of the shaft 141 to a second set of gear-wheels mounted on the platform 27 regardless of the position of the platform with respect to the base 23. The slider 143 thus acts exactly as the above described slider 121 does.

The upper end of the slider 143 is extended by a small co-axial gear-wheel which is integral with the slider and engages another gear-wheel 145, rotatably mounted about a pivot 147 fixed to the plate 61 of the slidable platform 27. The pivot 147 also acts as an axis for a lever 151 provided with an operation knob 153 mounted at the end opposite to the end of the lever fixed to the pivot 147. To limit the rotational movement of the lever 151 about the pivot 147, a pin (not shown) is mounted in a guiding slot 155 provided through the surface of the lever 151. A screwable knob 157 is mounted onto the pin for rigidly screwing and thus fixing the lever 151 in one given direction with respect to its pivot 147.

The lever 151 also supports another small gear-wheel 149 which is mounted thereon in engagement with gear wheel 145. Gear wheel 149 is rotated by gear wheel 145 when gear wheel 143 is rotated by the shaft, regardless of the location of platform 27 with respect to the base 23 and regardless of the position of lever 151 about its pivot 147.

The pivot 147 and the lever 151 are mounted in such a manner that, in a first extreme position shown in FIG. 4, wheel 149, when rotated by the wheel 143 via the wheel 145, rotates idly. In a second extreme position, shown in FIG. 5, the wheel 149 engages one of the gear-wheels 159. Wheels 159 are mounted on the upper surface of disc 67 of the mobile head between pairs of gear-wheels 75. Gear-wheels 75 are mounted at the upper ends of the threaded rods 71 for rotating the same about their respective axes in the same direction. As can be easily understood, the requirement of rotating all the threaded rods 71 in the same direction involves the presence of one gear-wheel 159 between each pair of gear-wheels 75, as is clearly shown in FIGS. 4 and 5.

As can also be understood, when lever 151 is placed in the extreme position shown in FIG. 5, the rotational movement of the driving shaft 141 is transmitted to the threaded rods 71 via the gear-wheels 143, 145, 149, 159 and 75. Of course, all the threaded rods 71 rotate in the same direction. The number of gear-wheels and their respective positions are selected so that the threaded rods 71, when driven in rotation about their respective axes, all rotate in the direction ensuring self-unwinding of the fusible elements 11. In the particular case of the machine shown in the accompanying drawings, this unwinding direction of rotation will be counter-clockwise when seen in a top plan view.

In order to prevent disc 67 from rotating when lever 151 is placed in the position where it allows rotation of the threaded rods 71, a blocking arm 161 is provided. This arm is connected at one end to the lever 151 and is mounted about a rigid pivot 163 in order to be automatically operated in a cantilever manner when lever 151 is moved. The free end of the arm 161 is provided with one pin 165 which may engage one recess 167 provided on the periphery of the disc 67. As can therefore be seen by mere comparison of FIGS. 4 and 5, the rotation of the lever 151 about the axis 147 involves simultaneous rotation of the arm 161 about its own axis 163 until the pin 165 engages the recess 167. This engagement provides firm holding of the disc 67 and therefore prevents the same from rotating when the threaded rods 71 rotate about their respective axes.

It should be noted that the gear ratio of the various gear-wheels used for rotating the threaded rods 71 about their respective axes is selected so that the rotational movement of the threaded rods 71 is synchronized to the translational movement of the slidable platform 27 upwardly along the guiding rods 31. This ensures self-unwinding of the fusible elements inside the casing 5 while the mobile head 37 moves upwardly out of the casing and prevents any binding or friction and therefore prevents the fusible elements 11 from breaking.

Figure 10C:
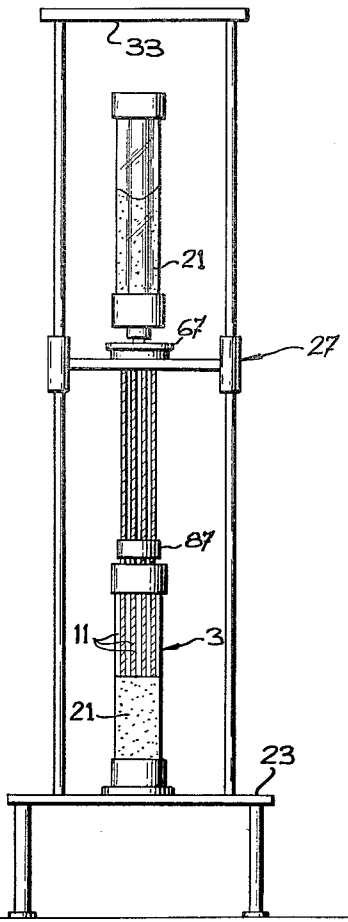
FIGS. 10*a*, 10*b* and 10*c* are side elevational, diagrammatic views of the machine shown in FIG. 1 in operation.
Figure 10B:
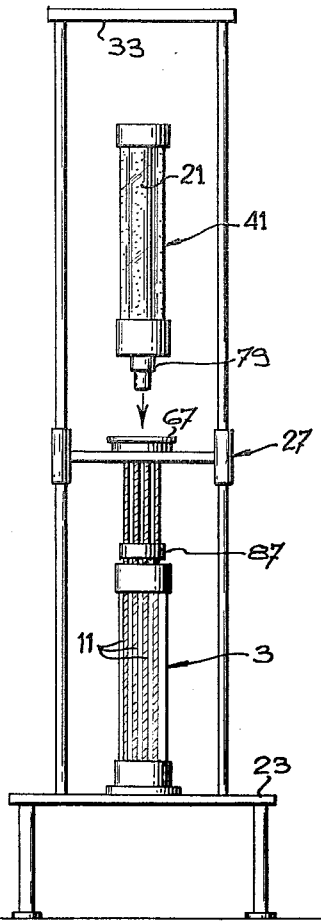
Figure 10A:
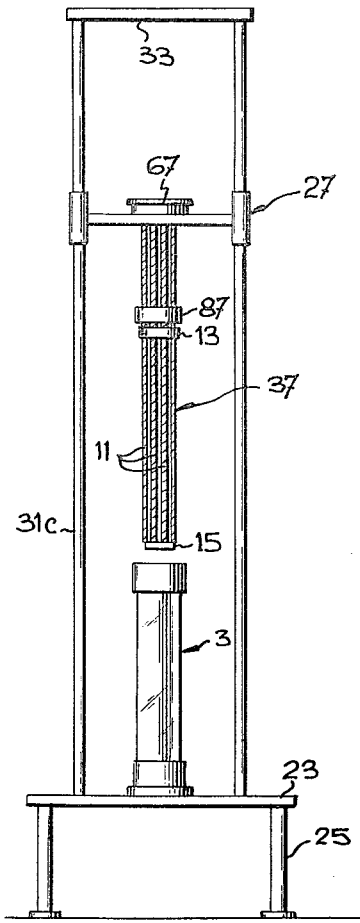

The operation of the improved apparatus which has been structurally described hereinabove will now be explained in greater detail, with particular reference to FIG. 10 of the drawings.

In a first step, the slidable platform 27 is lowered by operation of the motor until it reaches a lower position. When this first step is completed, the rings 13 and 15 of the fuse 3 to be assembled, are mounted onto the mobile head 37 by means of their respective attachment devices.

The apparatus for rotating the threaded rods 71 about their respective axes is then disconnected by rotation of the lever 151 to its disengaged position shown in FIG. 4. In contrast, the apparatus for rotating the mobile head as a whole about its central axis is connected by screwing the mandrel 119 so that the endless screw 35 may transmit its rotational movement to the driving shaft 117 and therefore to the disc 67. Once this engagement and disengagement have been carried out, the fusible elements 11 are welded onto the upper ring 13 and are inserted into the thread of the threaded rods 71. The motor is then operated to raise the platform at constant speed with simultaneous rotation of the mobile head 37 about its central axis. This combined movement of translation and rotation ensures self-positioning of the fusible elements 11 in the threads of the threaded rods 71. The fusible elements are then helically wound in a perfect manner.

When the fusible elements 11 wound in the threads have reached the level of the lower ring 15, the motor is stopped and the lower ends of the fusible elements are welded directly onto the lower ring 15.

Of course, it should be mentioned that the rotational movement of the mobile head is selected in such a manner that the fusible elements 11 may be suitably wound. In the case of the machine shown in the accompanying drawings, this rotation is carried out in a counter-clockwise direction when seen in top plan view.

However, if the fusible elements were first welded to the lower ring 15, it would be necessary to rotate the mobile head in the other direction, that is, when seen in top plan view, clockwise, while simultaneously moving the platform 27 downwards in translation for winding the fusible element as desired.

If the fuse to be assembled has to be provided with an indicator, a resistive wire (not shown) connected to an indicator can be fixed to the lower ring and held by a rod that will be inserted inside a tube 42, shown in FIG. 1, passing through the supply tube 77.

Once the fusible elements are mounted and welded to their respective fixation rings, the tubular casing 5 is inserted and rigidly fixed onto the mobile head. The lower cap 9 of the fuse 3 is then fixed to the lower ring 15 by screwing bolts onto its attaching apparatus 105.

The apparatus for rotating the mobile head and the apparatus for rotating the threaded rods are both disengaged and the slidable platform supporting the tube 5 and the lower cap 9 is lowered by operating the motor until the lower end of the fuse 3 is engaged in the support 53 mounted on the base and is solidly fixed therein by screw 57 (see FIG. 2). The upper ring 13 is then fixed to the upper end of the tube 5 and the apparatus for rotating the threaded rods about their respective axes is then engaged by rotating the lever 151 until it reaches its operative position shown in FIG. 5. The hopper 41 is then filled with the pulverulent filler 21 and mounted onto the mobile head 37 in cooperative relationship with the supply tube 77.

Subsequently, the motor 47 is operated together with the vibrator. This operation of the motor results in an upwards translation of the platform 27 with simultaneous rotation of the threaded rods 71 about their respective axes. This combined and synchronized movement of rotation and translation results in a helical self-unwinding of the fusible elements 11 inside the tubular casing 5. Simultaneously, the pulverulent filler 21 moves downward by gravity through the supply tube 77 and fills the tubular casing as the mobile head is moving upwardly, thus ensuring immobilization of the fusible elements 11 inside the casing as soon as they are disengaged from the threaded rods. The pulverulent filler that falls is compacted by the vibrator and this action is continued until the two rings 13 and 15 are completely disengaged from the mobile head 37.

When the mobile head 37 is completely removed from the tubular casing 5, the resistive wire originally mounted inside the tube 42 can be fixed to the upper ring to complete the fuse. The upper cap 7 of the fuse is then mounted and sealed directly onto the upper end of the casing 5. The filling of the fuse can be completed by addition of the required amount of pulverulent filler through a small opening provided in the upper cap.

As can therefore be understood, the combined action of the slidable platform and mobile head ensures perfect winding of the fusible elements about the mobile head. Subsequently, this combined movement, in reverse, ensures removal of the head from the casing and ensures self-unwinding of the fusible elements inside the casing. This movement and operation can be carried out whatever be the shape, size or mechanical characteristics of the fusible elements 11 as the structure of the machine according to the invention reduces binding and friction to a minimum.

Of course, various modifications can be made to the machine which has been described hereinabove within the scope of the present invention. Thus, by way of example, the machine that has been described, could be completely automated to avoid any manual work by an operator. Use could also be made of a coupling apparatus mounted on the mobile platform for transmitting the rotational movement of the driving shaft either to the disc or to the threaded rods or to both of them, which would be completely different from what has been previously described by way of example.

I claim:

1. An improved machine for assembling high voltage fuses without an internal core, said fuses comprising at least one fusible element helically wound inside a tubular casing made of electrically insulating material and filled with a pulverulent arc-quenching filler, said machine comprising:

a base provided with means for receiving and supporting the tubular casing of the fuse;

a platform slidably mounted along guide means positioned so as to allow motion of the platform in a direction perpendicular to the base;

means for moving the platform along the guide means towards the base or away from the base;

a mobile head mounted onto the platform, said mobile head comprising a rotation axis directed towards the base and means for helically winding said at least one fusible element about the mobile head and subsequently helically unwinding said at least one fusible element inside the tubular casing;

means for rotating said mobile head about its axis in at least one direction;

hopper means for filling said tubular casing with a pulverulent arc-quenching filler in order to secure the fusible elements when the same are unwound from the mobile head;

at least three threaded rods symmetrically mounted about the rotation axis of said mobile head, the threads of said rods forming said means for winding and unwinding said at least one fusible element, and means for simultaneously rotating the threaded rods at the same speed and in the same direction about their respective axes, said means for rotating the threaded rods being coordinated with the means for moving the platform along its guide means so that the rotation of the rods about their axes is synchronized with the translation movement of the slidable platform on which the rods are mounted when said platform moves away from the base and is carried in a direction ensuring self-unwinding of said at least one fusible element mounted onto the threads of the rods inside the tubular casing.

2. The machine according to claim 1, wherein said fuses further comprise two rings respectively mounted at both ends of the tubular casing for fixing the ends of said at least one fusible element, said machine further comprising means for removably fixing each ring onto the mobile head at spaced apart positions substantially corresponding to the length of the tubular casing of the fuse.

3. The machine according to claim 2, wherein one of said means for fixing one of said rings is mounted at the end of the mobile head opposite to the platform while the other of said means for fixing the other ring is provided with means for adjusting its position along the head for varying the distance between the rings depending on the length of the tubular casing of the fuse.

4. The machine according to claim 3, wherein said means for guiding the platform comprises at least one guide rod rigidly fixed to the base and on which is slidably mounted at least one sleeve rigidly fixed to the platform.

5. The machine according to claim 4, comprising three guide rods fixed onto the base and on each of which is slidably mounted a sleeve rigidly fixed to the platform.

6. The machine according to claim 4 wherein said means for moving the platform along said at least one guide rod comprises an endless screw to which the platform is engaged, and a reversible motor connected to the endless screw for rotating it in one direction or the other.

7. The machine according to claim 6, wherein the reversible motor and endless screw are mounted on the base, the endless screw extending parallel to said at least one guide rod.

8. The machine according to claim 7, wherein said base and platform extend in horizontal planes, said at least one guide rod, mobile head and endless screw extend vertically, and said hopper means for filling the tubular casing with filler during unwinding of said at least one fusible element comprises a hopper mounted above the platform and a supply tube extending from the bottom of the hopper down to the lower end of the mobile head for letting the pulverulent filler fall by gravity from the hopper to the tubular casing when the mobile head is moving up.

9. The machine according to claim 8, further comprising a vibrator connected to said base for facilitating the downward movement of the filler and for compacting the same inside the tubular casing.

10. The machine according to claim 8 or 9, wherein said filler supply tube is rigid and acts as a support for said means for fixing the rings of the fuses.

11. The machine according to claim 1, 3 or 9, wherein the mobile head comprises six threaded rods.

12. The machine according to claim 1, 3 or 9, wherein the mobile head comprises eight threaded rods.

13. The machine according to claim 1, 3 or 9, wherein the threaded rods of the mobile head are removable and interchangeable with other rods having different threads depending on the nature and size of said at least one fusible element.

14. The improved machine according to claim 6, wherein said means for rotating the mobile head about its axis comprises a first driving shaft mounted parallel to the endless screw, first coupling means engageable between the endless screw and said first driving shaft for transmitting, when engaged, the rotation of the endless screw to said first driving shaft, and a first set of gear-wheels mounted on the platform for transmitting the rotation of said first driving shaft to a disc-shaped support rotatably mounted on the platform and under which is coaxially mounted the mobile head, said first set of gear-wheels including a slider mounted on the first driving shaft for transmitting the rotation of said first driving shaft to the mobile head via the rotating disc-shaped support regardless of the position of the platform with respect to the base.

15. The improved machine according to claim 14, wherein:

the first coupling means of the first driving shaft comprises a belt connecting a first pulley mounted to said first driving shaft to a second pulley mounted to said endless screw, and means for disengaging said first coupling means from said first driving shaft;

said first set of gear-wheels comprises a first gear-wheel coaxially mounted on the slider of the first driving shaft, said slider being mounted to a bearing forming an integral part of the platform for letting the slider rotate about its axis together with the first driving shaft, and a second gear-wheel coaxially mounted on the disc-shaped support of the mobile head and positively engaged by the first gearwheel for rotating the disc-shaped support when the first gear-wheel is itself rotated by the first driving shaft.

16. The machine according to claim 14, wherein said means for rotating the threaded rods simultaneously at the same speed and the same direction about their respective axes comprises a second driving shaft mounted parallel to the endless screw, second coupling means mounted between the endless screw and the second driving shaft for transmitting the rotation of the endless screw to the second driving shaft, and a second set of gear-wheels mounted on said platform for transmitting any rotation of said second driving shaft to a third set of gear-wheels mounted on the disc-shaped support of the mobile head, said second set of gear-wheels being disconnectable and including a slider mounted onto the second driving shaft for transmitting the movement of said second driving shaft to the third set of gear-wheels regardless of the position of the platform with respect to the base, said third set of gear-wheels including means for rotating all the threaded rods of the mobile head in synchronization.

17. The machine according to claim 16, wherein:

the second coupling means comprises two gear wheels;

the second set of gear-wheels comprises a third gear-wheel axially mounted on the slider of the second driving shaft and at least one fourth gear-wheel rotated by the third gear-wheel, means for moving said third gear-wheel into and out of engagement with said third set of gear-wheels, and means for engaging said disc-shaped support and holding said disc-shaped support against rotation when said third gear-wheel is in engagement with said third set of gear wheels; and the third set of gear-wheels includes one fifth gear-wheel mounted to each of said threaded rods, and one sixth gear-wheel mounted between each two adjacent fifth gear-wheels, said third gear-wheel contacting one of said fifth gear-wheels, when engaged.

18. A method for assembling high voltage fuses without an internal core by use of a machine having a mobile head comprising at least three threaded rods symmetrically located around a central axis, said mobile head being movable in translation and rotatable about said axis, said method comprising:

a first step wherein at least one fusible element is helically wound onto said mobile head and into the threads of said rods, this step comprising the fixation of one end of the fusible element to a ring detachably mounted onto the mobile head, the rotation of the mobile head about said axis until the fusible element is completely wound into the threads of said rods, and the fixation of the other end of the fusible element to another ring detachably mounted onto the head;

a second step comprising the insertion of the mobile head into a tubular casing, the removal of both rings from the mobile head and their fixation to both ends of the tubular casing, and the positioning of the whole assembly adjacent to a base of said machine; and a third step wherein the fusible element is helically unwound from the mobile head inside the tubular casing by rotation of the threaded rods of said mobile head with simultaneous translation of said mobile head with respect to the tubular casing for helically unwinding said fusible elements inside the tubular casing, each of said rods being rotated about its own axis and all of said rods remaining in the same position relative to said central axis of said head, and simultaneously filling said tubular casing with a pulverulent arc-quenching filler for maintaining said fusible element in its original, helicoidal position when the same is helically unwound in the tube.

* * * * *